US007240778B2

(12) United States Patent
Duncanson et al.

(10) Patent No.: US 7,240,778 B2
(45) Date of Patent: Jul. 10, 2007

(54) PERSONALIZING LUGGAGE

(75) Inventors: David E. Duncanson, West Newbury, MA (US); Sung K. Park, Newton Center, MA (US)

(73) Assignee: Umagination Labs, L.P., Newton, MA (US)

( * ) Notice: Subject to any disclaimer, the term of this patent is extended or adjusted under 35 U.S.C. 154(b) by 0 days.

(21) Appl. No.: 11/185,464

(22) Filed: Jul. 20, 2005

(65) Prior Publication Data

US 2006/0037826 A1 Feb. 23, 2006

Related U.S. Application Data

(60) Provisional application No. 60/599,419, filed on Aug. 6, 2004.

(51) Int. Cl.
*A45C 3/08* (2006.01)
*A45C 13/08* (2006.01)
*A45C 13/10* (2006.01)

(52) U.S. Cl. ..... 190/125; 190/26; 190/102; 150/105

(58) Field of Classification Search ..... 190/26, 190/102, 125, 127, 124; 150/105
See application file for complete search history.

(56) References Cited

U.S. PATENT DOCUMENTS

| | | | | |
|---|---|---|---|---|
| 401,057 | A | 4/1889 | Perkins | |
| 651,079 | A | 6/1900 | Lindenberg | |
| 1,569,142 | A | 1/1926 | Rippetoe | |
| 1,978,970 | A * | 10/1934 | Thornhill et al. | 150/130 |
| 2,531,302 | A | 11/1950 | Schwennicke | |
| D164,621 | S * | 9/1951 | Bienen | D3/233 |
| 2,813,602 | A | 11/1957 | MacArthur, Jr. | |
| 2,912,079 | A | 11/1959 | Heitler | |
| 3,125,198 | A | 3/1964 | Stark | |
| 3,263,779 | A * | 8/1966 | Bialer | 190/110 |
| 3,381,782 | A | 5/1968 | Ikelheimer | |
| 3,388,777 | A | 6/1968 | Nolan | |
| 3,623,580 | A * | 11/1971 | Toller | 190/115 |
| 3,710,901 | A * | 1/1973 | Guard et al. | 190/107 |
| 4,270,590 | A | 6/1981 | Marshall | |
| 4,346,813 | A | 8/1982 | Cho et al. | |
| 4,420,068 | A | 12/1983 | Gerch | |
| 4,540,071 | A | 9/1985 | Schaub et al. | |
| 4,629,040 | A | 12/1986 | Jones | |
| 4,854,431 | A | 8/1989 | Pulichino, Jr. et al. | |
| D311,276 | S | 10/1990 | Workman | |
| 5,107,971 | A | 4/1992 | Freeman | |

(Continued)

FOREIGN PATENT DOCUMENTS

GB 1458044 12/1976

OTHER PUBLICATIONS

International Search Report and Written Opinion; PCT/US05/27343; mailed Nov. 30, 2006.

*Primary Examiner*—Sue A. Weaver
(74) *Attorney, Agent, or Firm*—Fish & Richardson P.C.

(57) ABSTRACT

Luggage with modular construction permits personalization and customization by interchangeable appearance covers, by interchangeable lids and by interchangeable primary containment perimeters, so that the luggage can be selectively constructed with a hard or soft upper containment perimeter and lid, or such that the aesthetic treatment of the lid or other panels can be changed very easily by means of a releasable fasteners.

7 Claims, 6 Drawing Sheets

U.S. PATENT DOCUMENTS 5,150,776 A 9/1992 Rebenack
5,356,004 A 10/1994 Weinreb
5,431,265 A 7/1995 Yoo
5,480,030 A 1/1996 Sweeney et al.
5,503,204 A * 4/1996 Byers et al. ..... 150/105
5,529,156 A 6/1996 Yang
5,533,558 A * 7/1996 Carey et al. ..... 150/105
5,553,558 A 9/1996 Wagner
5,560,479 A * 10/1996 Leyba et al. ..... 206/315.5
5,685,401 A 11/1997 Macgillivray et al.
5,746,360 A 5/1998 Chen
5,788,032 A 8/1998 Krulik
5,996,749 A 12/1999 Hillsberg et al.
6,000,509 A 12/1999 Chisholm
6,029,810 A 2/2000 Chen
6,050,373 A 4/2000 Wonka et al.
6,109,402 A 8/2000 Godshaw et al.
6,173,837 B1 1/2001 Marconi
6,173,839 B1 1/2001 Dieter et al.
6,234,287 B1 5/2001 Pfeiffer
6,260,680 B1 7/2001 Lin
6,283,260 B1 9/2001 Yasuda, Sr.
6,286,645 B1 * 9/2001 Chen ..... 190/125
6,435,324 B1 8/2002 Hoberman
6,508,358 B2 1/2003 Cheng
6,640,944 B2 11/2003 Adams
6,749,273 B1 6/2004 Peterson
2002/0027052 A1 3/2002 Godshaw et al.
2002/0148743 A1 10/2002 Tong
2003/0038008 A1 2/2003 Han
2003/0192896 A1 10/2003 Palmer
2003/0209396 A1 11/2003 Bernbaun et al.
2004/0003975 A1 1/2004 Dulin
2004/0173427 A1 9/2004 Chernoff
2006/0021684 A1 * 2/2006 DeCoro, III ..... 150/105

* cited by examiner

PERSONALIZING LUGGAGE

CROSS-REFERENCE TO RELATED APPLICATIONS

This application claims the benefit of U.S. Provisional Application No. 60/599,419, filed Aug. 6, 2004 and entitled "Personalizing Luggage," which is incorporated by reference herein.

TECHNICAL FIELD

This invention relates to luggage and other personal, totable or wheeled containers for transporting personal effects.

BACKGROUND

Commercial luggage is available in several styles and colors. Typically, a consumer selects a color and style based on personal preference at the time of purchase, and if tastes later change, purchases additional luggage.

SUMMARY

Various aspects of this invention feature luggage, such as a suitcase, or other containers for a user to personally transport his or her personal effects, with one or more outer panels selectively removable and replaceable with one or more panels of similar construction but with different outer appearance, to alter the visual appearance of the luggage or container.

According to one aspect of the invention, luggage includes a main frame defining an internal compartment for items to be packed and transported, and at least one outer panel secured to the frame and forming an outer surface of one side of the luggage. The panel is releasably secured to the frame for replacement with any of a number of interchangeable panels of differing visual or tactile properties.

Preferably, the outer panel extends across a majority of one side of the luggage, or more preferably, across substantially all of one side of the luggage.

In many constructions, the frame includes a sub-panel forming an interior surface of the luggage and covered by the outer panel. In some cases, the sub-panel defines slots into which tabs of the outer panel are releasably secured. The outer panel tabs may define apertures sized to accept respective fastening clips disposed on a side of the sub-panel opposite the outer panel, to hold the outer panel to the sub-panel. Such fastening clips, in some embodiments, include springs compressed between an inner surface of the sub-panel and an opposing surface of their respective tabs. Each spring may define a recess sized to receive a feature of the tab when the clip is fully engaged. In some cases, each spring clip includes a pair of spring fingers with outer, oppositely directed cam surfaces for engagement with the tab as the spring fingers are inserted through the tab. The spring clip may also have an inclined surface that progressively engages the tab as the spring clip is pressed into full engagement, to draw the outer panel against the sub-panel.

In some cases, the outer panel has projections extending from its inner side, and the frame defines respective holes arranged to receive the outer panel projections. Some such examples also include removable clips releasably engaging the outer panel projections with the projections extending through the frame holes, to secure the outer panel to the frame. Such projections may be mushroom-shaped, with each clip including a pair of spring fingers with opposing cam surfaces configured for engagement with a stem portion of its respective projection. Each clip may also include a third spring finger resiliently deflectable in a direction perpendicular to a normal deflection direction of the pair of spring fingers and arranged to engage an upper surface of a head of the mushroom-shaped projection. The third spring finger may also have a nib projecting toward the pair of spring fingers and arranged to be received in a recess defined in the upper surface of the projection head.

In some cases, the spring clips are caps pressed over distal ends of their corresponding projections. In an illustrated example, each projection includes an outer lip extending radially from an outer surface of the projection, each projection also defining a slot along one side, enabling resilient collapse of the projection. In such cases, the frame holes are preferably sized to require temporary collapse of the outer panel projections during attachment of the outer panel to the frame. The cap, in some configurations, defines an inwardly extending rim positioned for engagement with the outer lip of the projection when the cap is secured to the projection. The cap may also have a central nib extending from its inner surface, the nib of a size selected to cause the outer lip of the projection to be forced outward into secure engagement with the rim of the cap as the cap is pressed onto the projection.

In some examples, the outer panel is releasably secured to the frame by fasteners accessible from inside the luggage.

In some cases, the outer panel carries a graphic image visible from outside the luggage.

In some configurations, the frame includes a hinged side openable for accessing contents of the luggage, for example with the outer panel disposed on the hinged side of the luggage.

Another aspect of the invention features a method of personalizing luggage. The method includes removing a first outer panel from a side of a piece of luggage, and securing a second outer panel to the side of the piece of luggage from which the first outer panel was removed, effectively replacing the first outer panel with the second outer panel, where the second outer panel is of a different outer visual appearance than the first outer panel.

In some instances, the removable panel is releasably secured to a frame of the luggage or container by one or more releasable fasteners that are configured to reduce the chance of inadvertent release.

Other aspects of this invention feature removable spring clips and fastening systems as shown and described herein, which may be employed as releasable fasteners in several applications beyond personal luggage.

The modular luggage construction approach disclosed herein permits personalization and customization by interchangeable appearance covers, by interchangeable lids and by interchangeable primary containment perimeters, so that the luggage can be selectively constructed with either a hard or soft upper containment perimeter and lid, and so that aesthetic or tactile treatment of the lid can be changed very easily by means of a unique fastening system. In some cases, the lower containment perimeter is affixed to the chassis by custom fasteners that allow release only by a tool provided with the system, while the outer appearance shell is affixed to the lid by a perimeter fastening system that securely adheres the appearance shell but permits fast removal, either with a special tool provided with the system, or in some configurations without tools.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
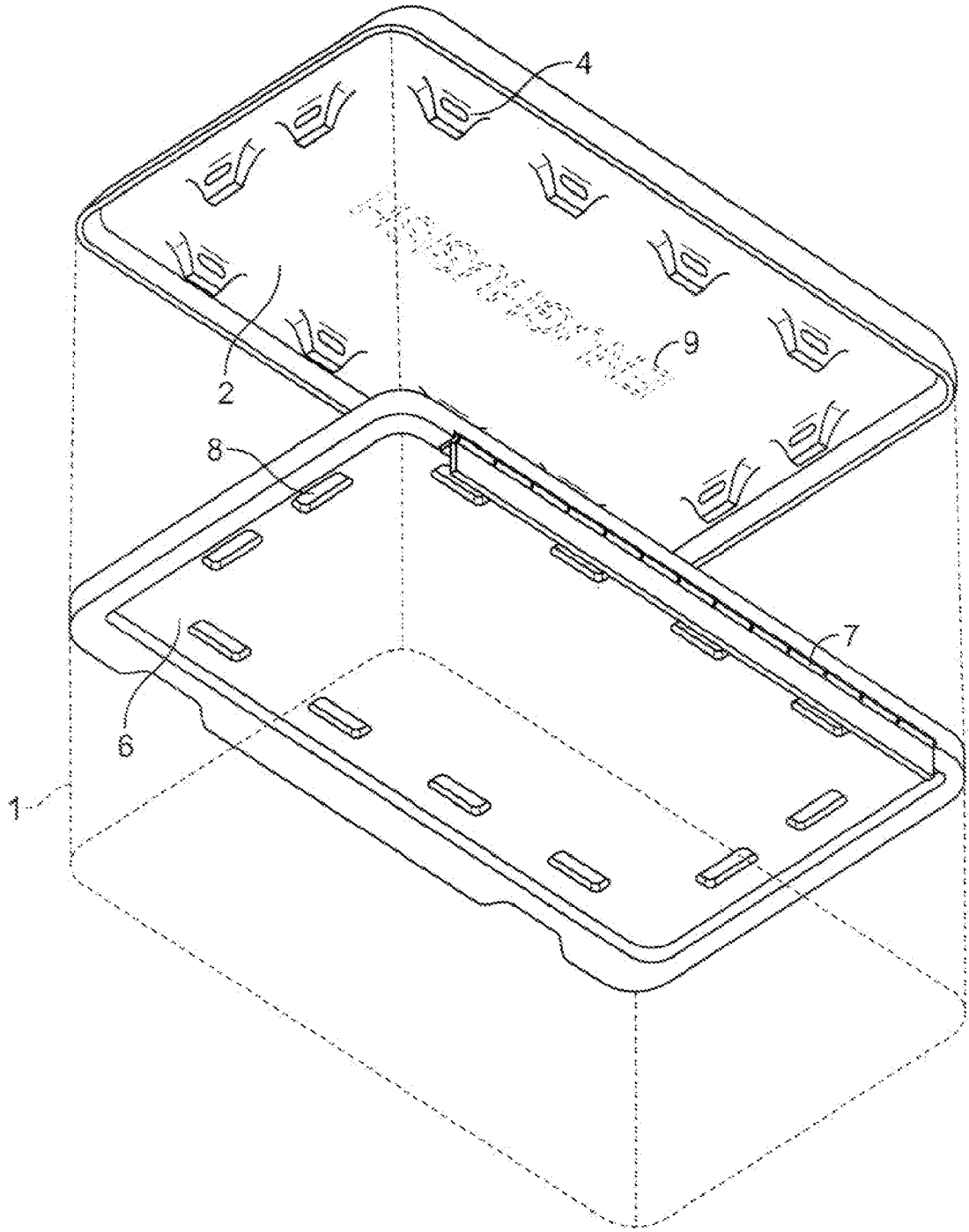
FIG. 1 is a perspective view of a side panel of a suitcase, otherwise shown in dashed outline, and a replaceable cover for the side panel.
Figure 2:
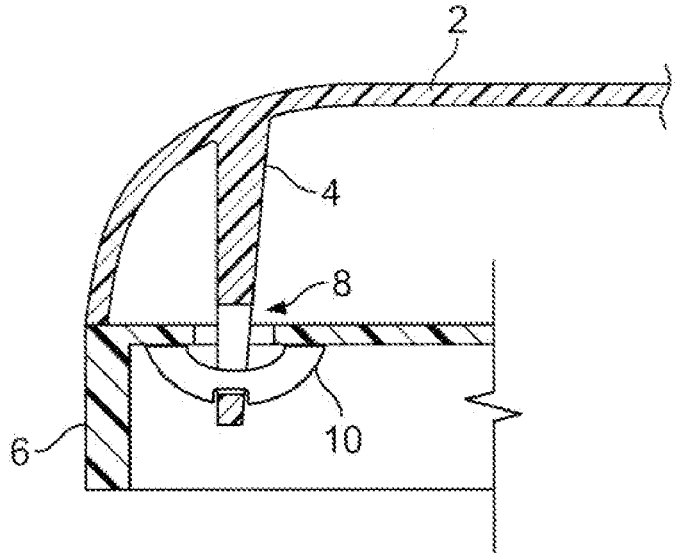
FIG. 2 is a cross-sectional view through an edge region of the side panel, with the cover secured.

Referring first to FIGS. 1 and 2, a suitcase 1 has a sub-cover 6 forming one side of the suitcase, and an interchangeable, releaseable cover 2 that can be secured in place to substantially cover sub-cover 6. Cover 2 has intergral, apertured tabs 4 that protrude thru respective slots 8 in the sub-cover, and are secured by fastener clips 10 inserted through the apertures in the tabs on an opposite side of sub-cover 6. Cover 2 is one of a set of covers of different outer styles and/or colors, any one of which may be selectively secured to sub-cover 6 to alter the outer appearance of that side of suitcase 1. Although only one cover is illustrated, covering a single side of suitcase 1, it will be understood that the other sides of the suitcase may be equipped with similar sub-covers and replaceable covers. In the embodiment shown, the structural integrity of suitcase 1 is provided by the sub-covers or other framework, and not by interchangeable covers. In this manner, the majority of the bulk of the suitcase remains relatively unaltered by cover replacement, and can be readily fashioned by known methods out of known materials, without significant cost increase over conventional suitcases of comparable size. The sub-covers or other framework define the internal compartment. In the embodiment shown in FIG. 1, sub-cover 6 forms the hinged lid of the suitcase. Sub-cover 6 can, for example, be attached to the framework of suitcase 1 along a hinged side 7.

Figure 3:
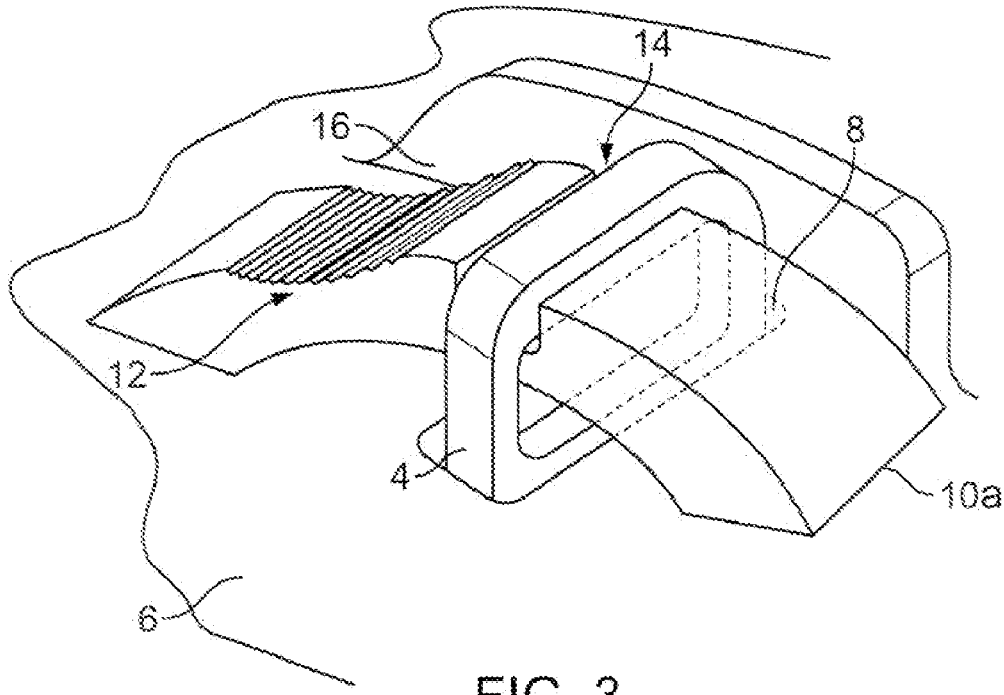
FIG. 3 is a perspective view of a first cover fastening means.
Figure 4:
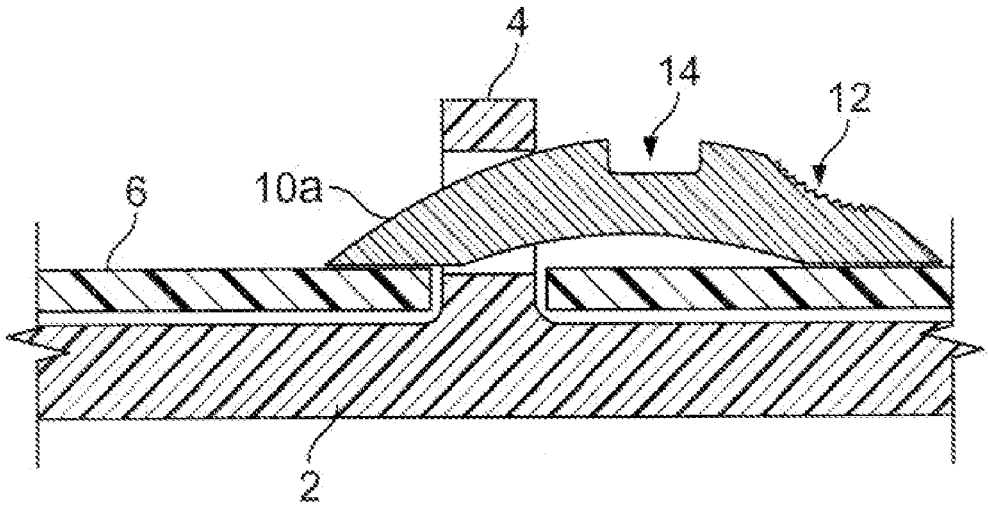
FIGS. 4 and 5 are cross-sectional views through the spring clip of FIG. 3, during and after engagement, respectively.
Figure 5:
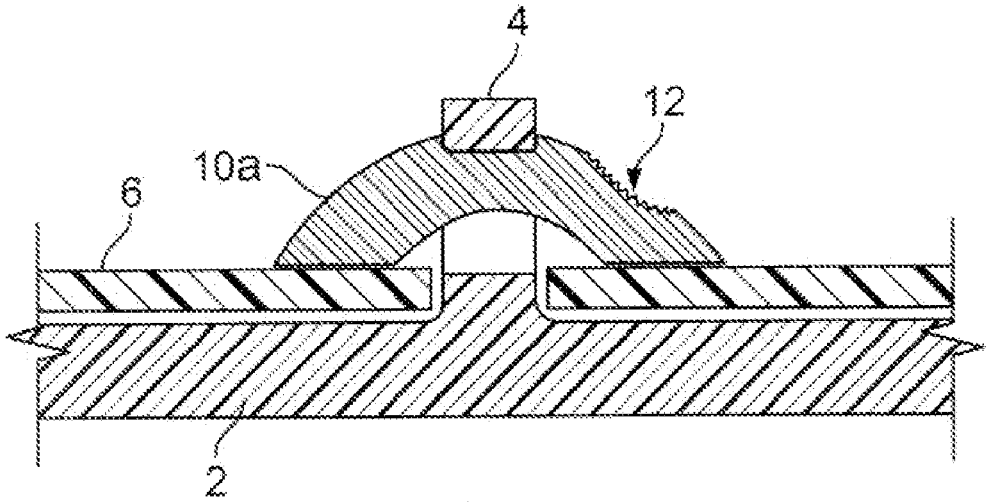

One version of the fastener clip 10*a*, shown in FIG. 3, is a spring clip of plastic or other material molded, extruded or otherwise formed in an arc. The clip defines a ribbed recess 12 for thumb engagement, and a slot 14 in the outer surface of the clip at the top of the arc that receives an inner surface of the apertured tab 4 of the outer cover as the clip is slid through the aperture of the tab on an inner side of sub-cover 6, as shown in FIGS. 4 and 5. Clip 10*a* is formed to engage the inner surface of the sub-panel at relatively wide, planar contact areas so as to provide a substantial clip retention force without overly stressing the sub-panel. In this example, sub-panel 6 includes a raised rib segment 16 (FIG. 3) adjacent and perpendicular to slot 8, to help block the spring clip from inadvertent compression by forces applied, for example, by shifting suitcase contents.

Figure 6:
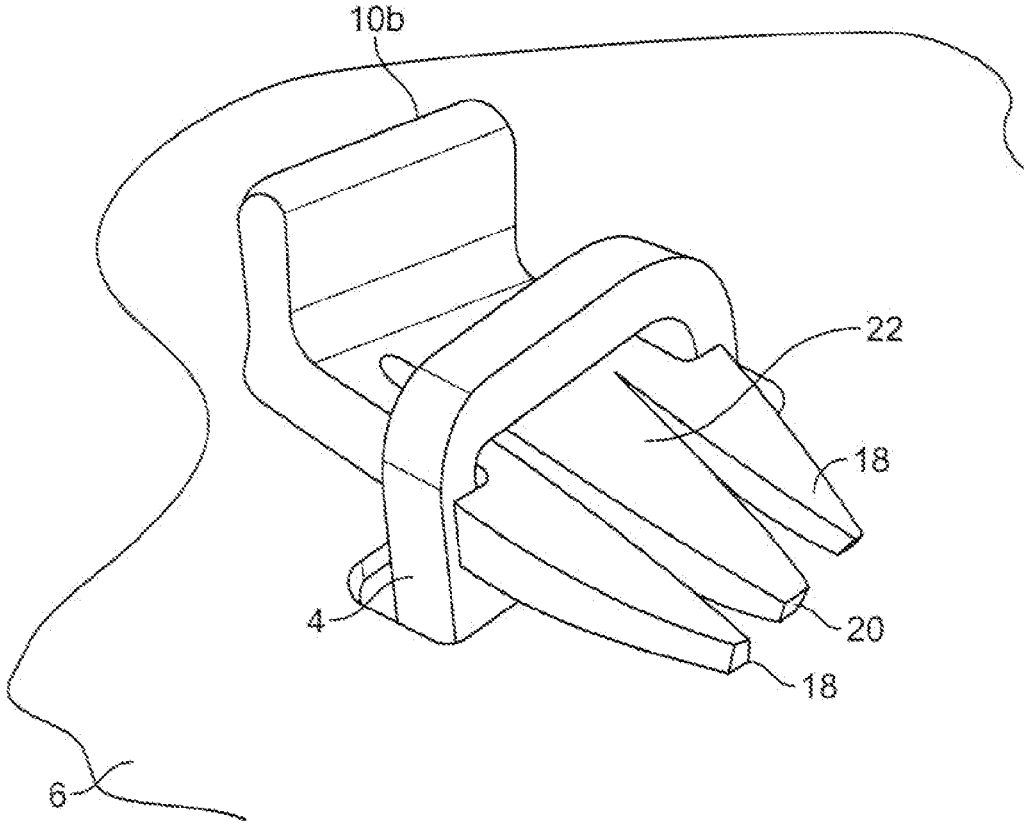
FIG. 6 is a perspective view of a second cover fastening means.
Figure 7:
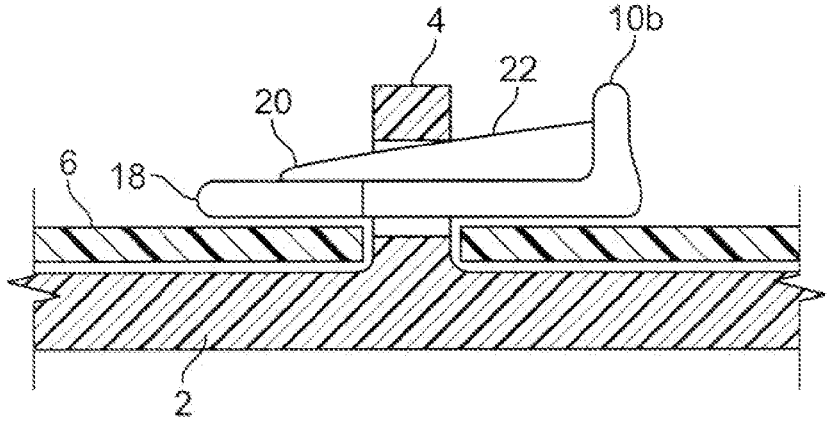
FIG. 7 is a cross-sectional view through the spring clip of FIG. 6, after engagement.

Another version of the fastener clip 10*b*, illustrated in FIGS. 6 and 7, is a three prong snap fastener that both snaps and wedges in place within the apertured tab 4 of the outer cover, to secure the cover to the sub-cover 6. Clip 10*b* is injection-molded plastic, with two outer spring fingers 18 defining lateral cam surfaces that engage opposing inner surfaces of tab 4, resiliently deflecting fingers 18 toward wedge finger 20 as the clip is pressed into place. When fully engaged, spring fingers 18 snap outwardly to secure the clip to the tab. A sloped upper surface 22 of wedge finger 20 progressively engages an underside of tab 4 to draw the outer panel securely against the sub-panel. Clip 10*b* is released by manually pinching the distal end of the clip to compress spring fingers 18 toward one another until their cam surfaces clear the sides of tab 4.

Figure 8:
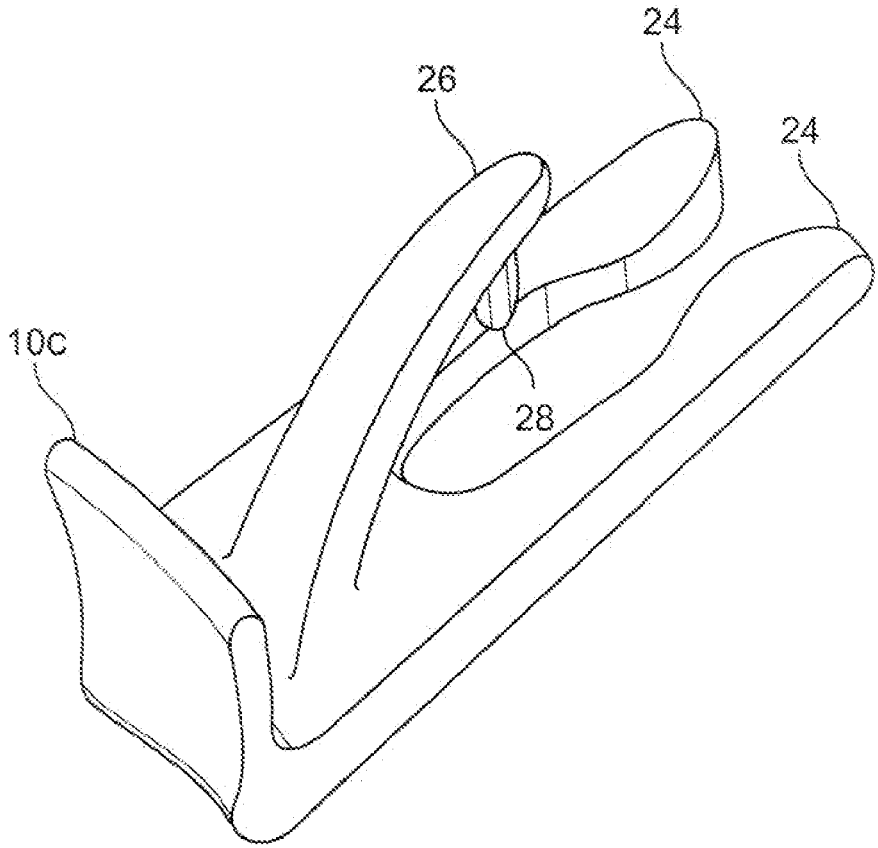
FIG. 8 is a perspective view of a third spring clip.
Figure 9:
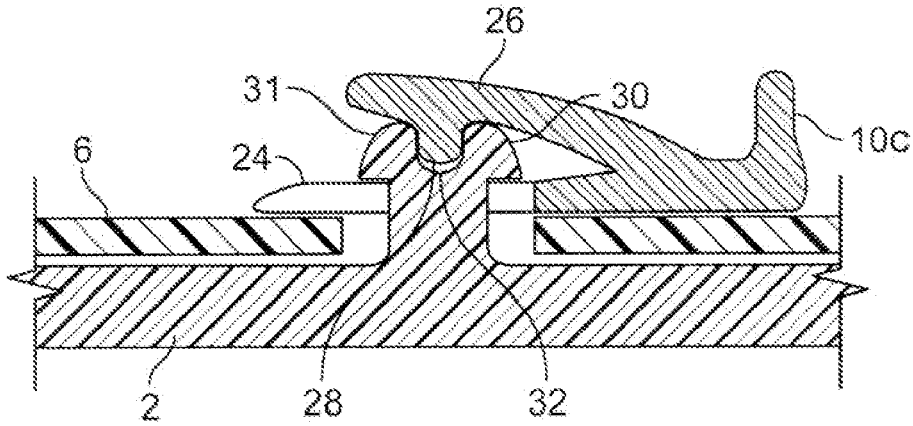
FIG. 9 is a cross-sectional view through the spring clip of FIG. 8, after engagement.
Figure 10:
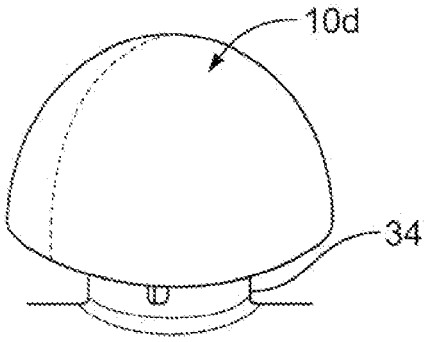
FIG. 10 is a perspective view of a fourth cover fastening means.
Figure 11:
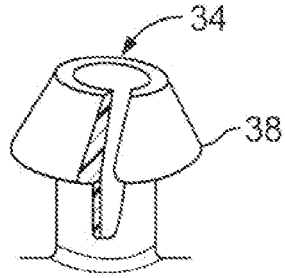
FIG. 11 is a perspective view of the cover projection of the fastening means of FIG. 10.

A third version of the fastener clip 10*c*, illustrated in FIGS. 8 and 9, is a two stage snap clip with two opposing lateral spring fingers 24 and an elevated spring finger 26 that deflects in a direction perpendicular to the deflection direction of lateral spring fingers 24. Elevated finger 26 has a downwardly projecting nib 28 near its distal end. Clip 10*c* is configured to releasably engage a mushroom-shaped projection 30 extending from the inner surface of the outer cover 2, as shown in FIG. 9. As the clip is forcibly slid into place along the inner surface of the sub-panel 6, inner cam surfaces of spring fingers 24 variably engage the stem of projection 30 while upper surfaces of spring fingers 24 engage the underside of the head 31 of projection 30 to secure the outer panel to the sub-panel. As clip 10*c* is pushed into full engagement, nib 28 of the elevated spring finger 26 is received within a recess 32 defined in the upper surface of the outer panel projection 30, providing additional clip retention means.

Figure 12:
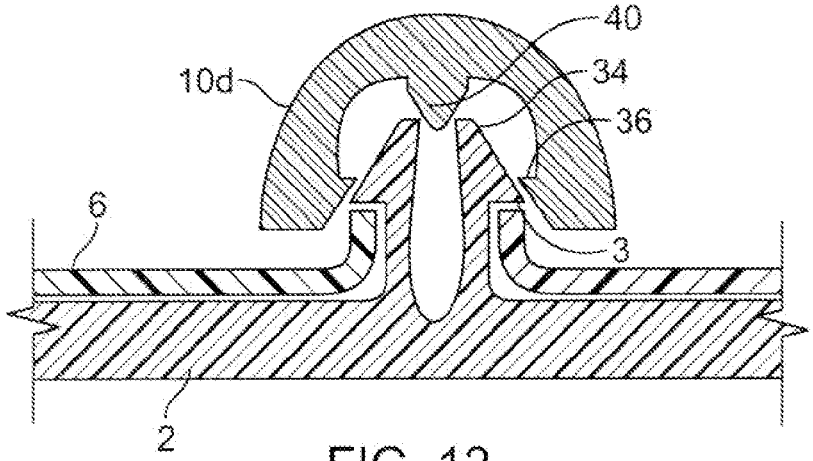
FIGS. 12 and 13 are cross-sectional views through the spring clip of FIG. 10, during and after engagement, respectively.
Figure 13:
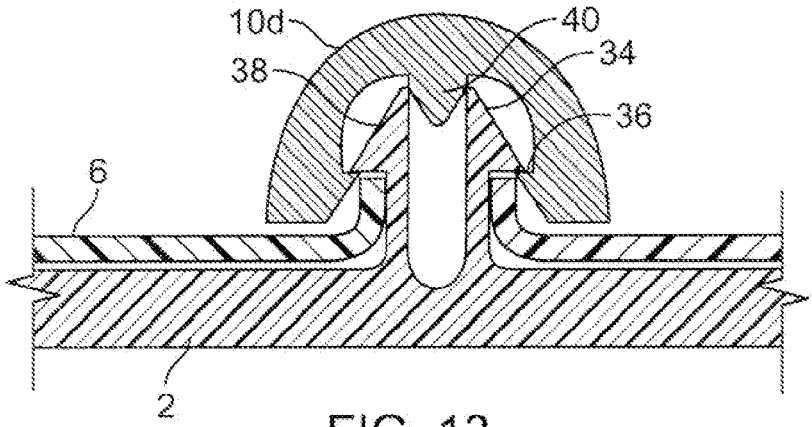

A fourth releasable fastener clip 10*d* and mating projection 34 are shown in FIGS. 10-13. Clip 10*d* is in the form of a hollow molded cap with an inwardly projecting inner lip 36 that snaps over an outer lip 38 of projection 34. Cap 10*d* is axisymmetric about the vertical axis of projection 34, while projection 34 is split along one side to allow the projection to resiliently collapse as the cap is pressed through a corresponding hole in sub-panel 6. As shown in FIGS. 12 and 13, during engagement of the cap onto the projection 34, a downwardly projecting, conical nib 40 at the center of the inner surface of cap 10*d* forces the outer lip 38 of projection 34 outward into secure engagement under the inner lip 36 of the cap. To remove the outer panel 2, the caps 10*d* are pried, pulled or otherwise released from their projections 34, which are then manually compressed, such as by pinching between fingers, for withdrawal through the holes in the sub-panel.

Referring again to FIG. 1, in some embodiments, releaseable cover 2 includes a graphic image 9 that is visible from outside suitcase 1.

Replacement outer panels can be provided with the luggage or as after-market accessories sold separately.

A number of embodiments of the invention have been described. Nevertheless, it will be understood that various modifications may be made without departing from the spirit and scope of the invention. Accordingly, other embodiments are within the scope of the following claims.

What is claimed is:

1. Luggage comprising a main frame defining an internal compartment for items to be packed and transported, the frame comprising a sub-panel forming an interior surface of the luggage, the sub-panel defining slots therethrough; and at least one outer panel secured to the frame and forming an outer surface of one side of the luggage, the panel covering the sub-panel of the frame and including tabs releasably secured into the slots of the sub-panel, the panel being releasably secured to the frame for the replacement with any of a number of interchangeable panels of differing visual or tactile properties, wherein the outer panel tabs define apertures therethrough, the apertures sized to accept respective fastening clips disposed on a side of the sub-panel opposite the outer panel, the fastening clips comprising springs compressed between an inner surface of the sub-panel and an opposing surface of their respective tabs, each spring defining a recess sized to receive a feature of the tab therein when the clip is fully engaged.

2. The luggage of claim 1 wherein the outer panel extends across a majority of one side of the luggage.

3. The luggage of claim 2, wherein the outer panel extends across substantially all of one side of the luggage.

4. The luggage of claim 1, wherein the fastener clips are accessible from inside the luggage.

5. The luggage of claim 1, wherein the outer panel carries a graphic image visible from outside the luggage.

6. The luggage of claim 1, wherein the frame includes a hinged side openable for accessing contents of the luggage.

7. The luggage of claim 6, wherein the outter panel is disposed on the hinged side of the luggage.

* * * * *